US005724908A

United States Patent [19]

Murray

[11] Patent Number: 5,724,908

[45] Date of Patent: Mar. 10, 1998

[54] REMOTE CONTROLLED BOAT DRAIN VALVE

[76] Inventor: Richard Murray, 701 Central Ave., Buffalo, Minn. 55313

[21] Appl. No.: 637,868

[22] Filed: Apr. 25, 1996

[51] Int. Cl.[6] ..... B63B 13/00

[52] U.S. Cl. ..... 114/197; 114/198

[58] Field of Search ..... 114/197, 198

[56] References Cited

U.S. PATENT DOCUMENTS

| | | | |
|---|---|---|---|
| 25,094 | 8/1859 | Clear | 114/198 |
| 3,036,541 | 5/1962 | Musick et al. | 114/197 |
| 3,757,726 | 9/1973 | Moeller | 114/197 |
| 3,797,442 | 3/1974 | McRae . | |
| 3,874,317 | 4/1975 | Hikita | 114/198 |
| 4,019,454 | 4/1977 | Landwerlen . | |
| 4,516,515 | 5/1985 | Johnson . | |
| 4,843,376 | 6/1989 | Wagner et al. . | |
| 5,048,556 | 9/1991 | Grumelot et al. | 114/197 |
| 5,162,793 | 11/1992 | Plost et al. . | |
| 5,182,556 | 1/1993 | Plost et al. . | |
| 5,362,266 | 11/1994 | Brogdon . | |

*Primary Examiner*—Stephen Avila
*Attorney, Agent, or Firm*—Hugh D. Jaeger

[57] ABSTRACT

A remote activated boat drain valve to drain the boat's bilge quickly from inside the boat without getting wet. The remote controlled boat drain valve also allows for the operator to drain the bilge quickly and easily while the boat is moving rapidly. The drain valve can also be used for a live well.

3 Claims, 5 Drawing Sheets

REMOTE CONTROLLED BOAT DRAIN VALVE

CROSS REFERENCES TO CO-PENDING APPLICATIONS

None.

BACKGROUND OF THE INVENTION

1. Field of the Invention—The present invention is for a remote controlled boat drain valve for either the stern of a boat or a live well, and more particularly, pertains to either an electromagnetically actuated or a manually actuated valve assembly for letting water out through the stern of a boat or out through a live well.

2. Description of the Prior Art—Prior art boat drains have usually been a plug in the stern of the boat, which is sometimes either misplaced or lost, or else the operator of the boat forgets to put it into the boat, which subsequently causes the boat to take on water and sometimes causes the boat to come close to sinking.

Also, live wells for fishing boats, or boats in general, have not always been easy to empty. The live wells would be much more easy and convenient to empty with a remote controlled boat drain valve, whether it be manually actuated or electromagnetically actuated.

The present invention overcomes the disadvantages of the prior art by providing a remote controlled boat drain valve.

SUMMARY OF THE INVENTION

The general purpose of the present invention is a boat drain valve, remote controlled either manually or electromagnetically, which can be used in the stern of a boat, on the boat in general, or in a live well for draining of fluids and liquids.

According to one embodiment of the present invention, there is provided a slide gate within a housing where the housing secures through the stern of a boat or through the wall of a live well. The slide gate is remotely controlled either by a hand actuated lever or by an electromechanical solenoid connected to an actuator cable.

Significant aspects and features of the present invention include a remote controlled boat drain valve which can be mounted through the stern of a boat or through the wall of a live well for emptying of fluids and liquids.

Having thus described embodiments of the present invention, it is the principal object of the present invention to provide a remote controlled boat drain valve which is actuated either by a lever or by an electromechanical device, such as a solenoid.

It is another object of the present invention to place the remote controlled boat drain valve either on the stern of a boat for emptying the bilge or in a wall or base of a live well for emptying of the live well.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
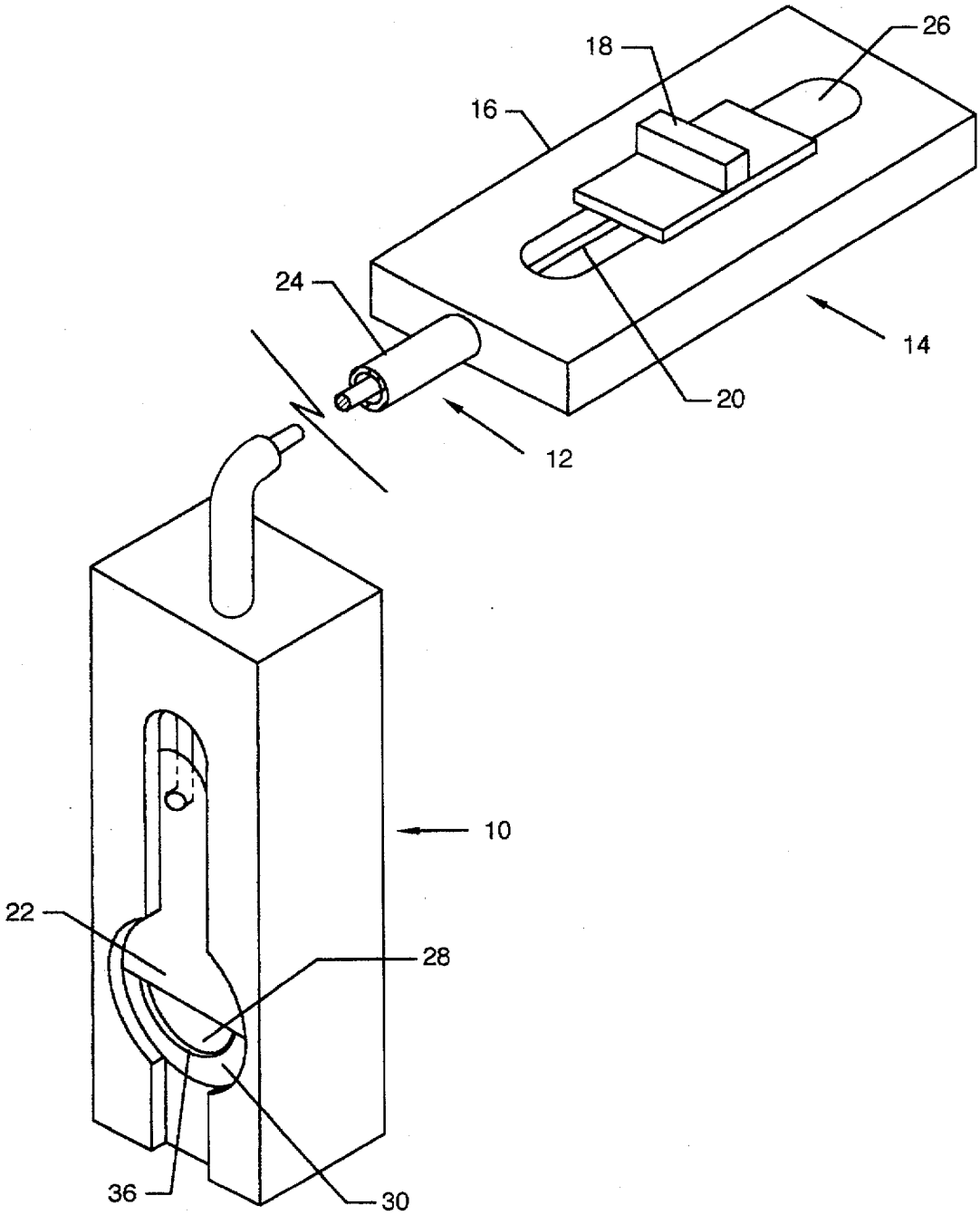
FIG. 1 illustrates an isometric view of a remote controlled boat drain valve, the present invention.

FIG. 1 illustrates an isometric view of a remote controlled boat drain valve consisting of a boat plug assembly 10, an actuator cable assembly 12, and an actuator remote control assembly. The actuator remote control assembly is made up of an actuator base 16, an actuator slide 18, both of which preferably are constructed of a suitable polymer, such as Delrin, and an actuator cable 20. The actuator cable 20, typically made of stainless steel, is appropriately secured to the actuator slide 18 on the underside of the actuator base 16, passes outward through an appropriately sized hole in the end of the actuator base 16 and is encased in a cable protector 24. The actuator cable assembly 12 consists of the actuator cable 20 and the cable protector 24, made of a suitable waterproof polymer, which is appropriately secured to the actuator base 16 where the actuator cable 20 extends out of the actuator base 16. The actuator cable assembly connects the actuator remote control assembly 14 to the boat plug assembly 10. The actuator cable assembly 12 is appropriately secured to the boat plug assembly 10 where the actuator cable passes through an appropriately sized hole in the boat plug assembly 10 and is appropriately connected to a slide gate 22. When engaged, the actuator slide 18 slides in an appropriately sized grooved slot 26, pulling the actuator cable through the cable protector 24, causing the slide gate 22 to move upwardly in suitable grooves, thus opening the drain hole 28. Disengagement of the drain valve occurs in a fashion similar to the engagement, except the actuator slide 18 is pushing, rather than pulling, the actuator cable 20, which causes the slide gate 22 to cover the drain hole 28 and seal the opening with use of an appropriate waterproof gasket 30.

Figure 2:
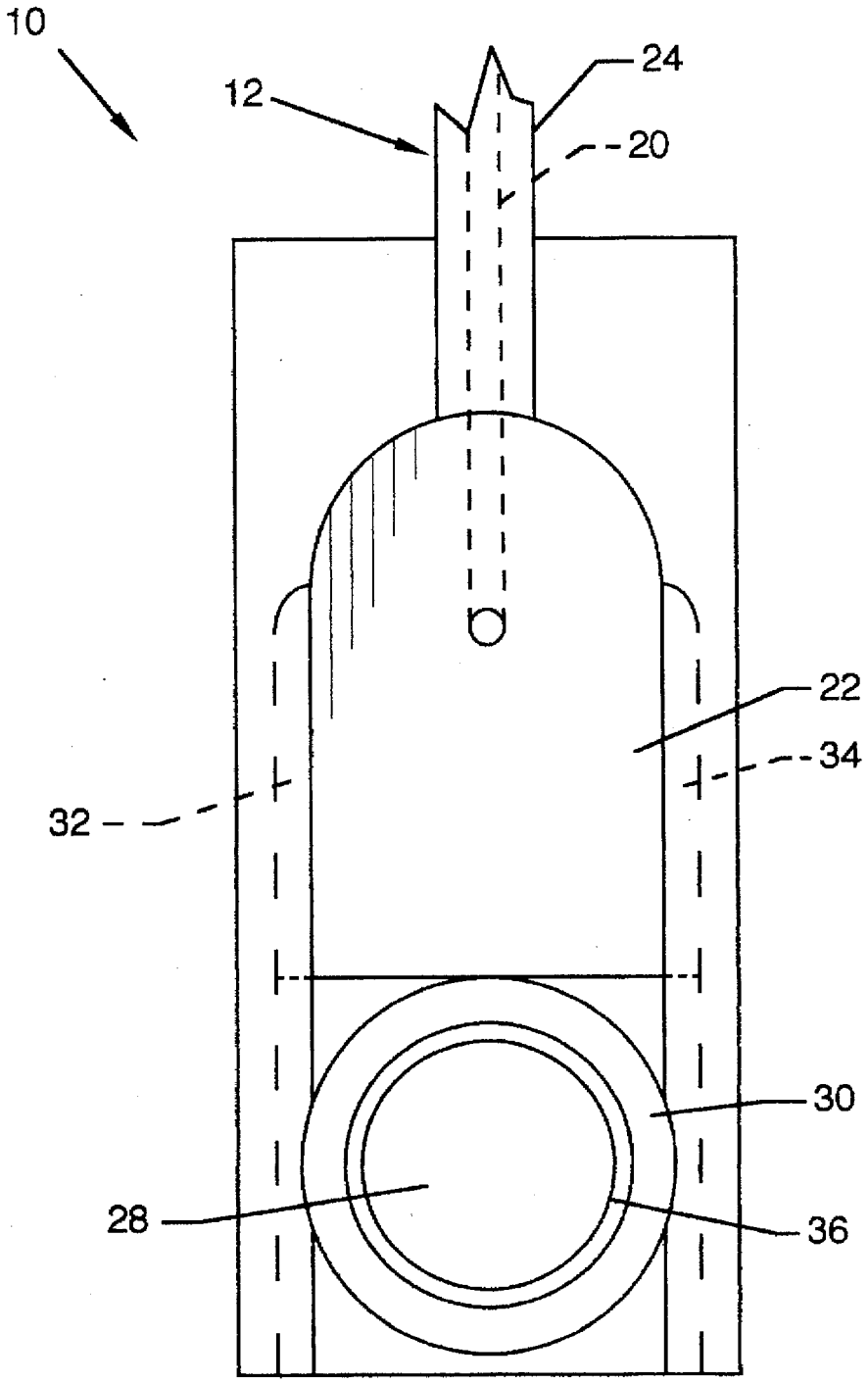
FIG. 2 illustrates a front view of the boat plug assembly with the drain valve open.

FIG. 2 illustrates a front view of the boat plug assembly 10 with the drain valve in an opened position, where all numerals correspond to those elements previously described. FIG. 2 further illustrates the grooves in which the slide gate 22 slides to engage the drain valve described in FIG. 1. The slide gate 22 moves in two identical opposing slide gate channels 32 and 34 when the actuator slide (not shown) is moved in either direction. FIG. 2 further illustrates how the actuator cable assembly 12 connects to the boat plug assembly 10, how the actuator cable 20 passes under the slide gate 22, and how the actuator cable 20 passes upward through the slide gate 22. Also shown in this illustration is the threaded drain tube 36 through which the water flows when the boat plug assembly 10 is engaged. The threaded drain tube 36 will be further described in FIG. 3 and FIG. 4.

Figure 3:
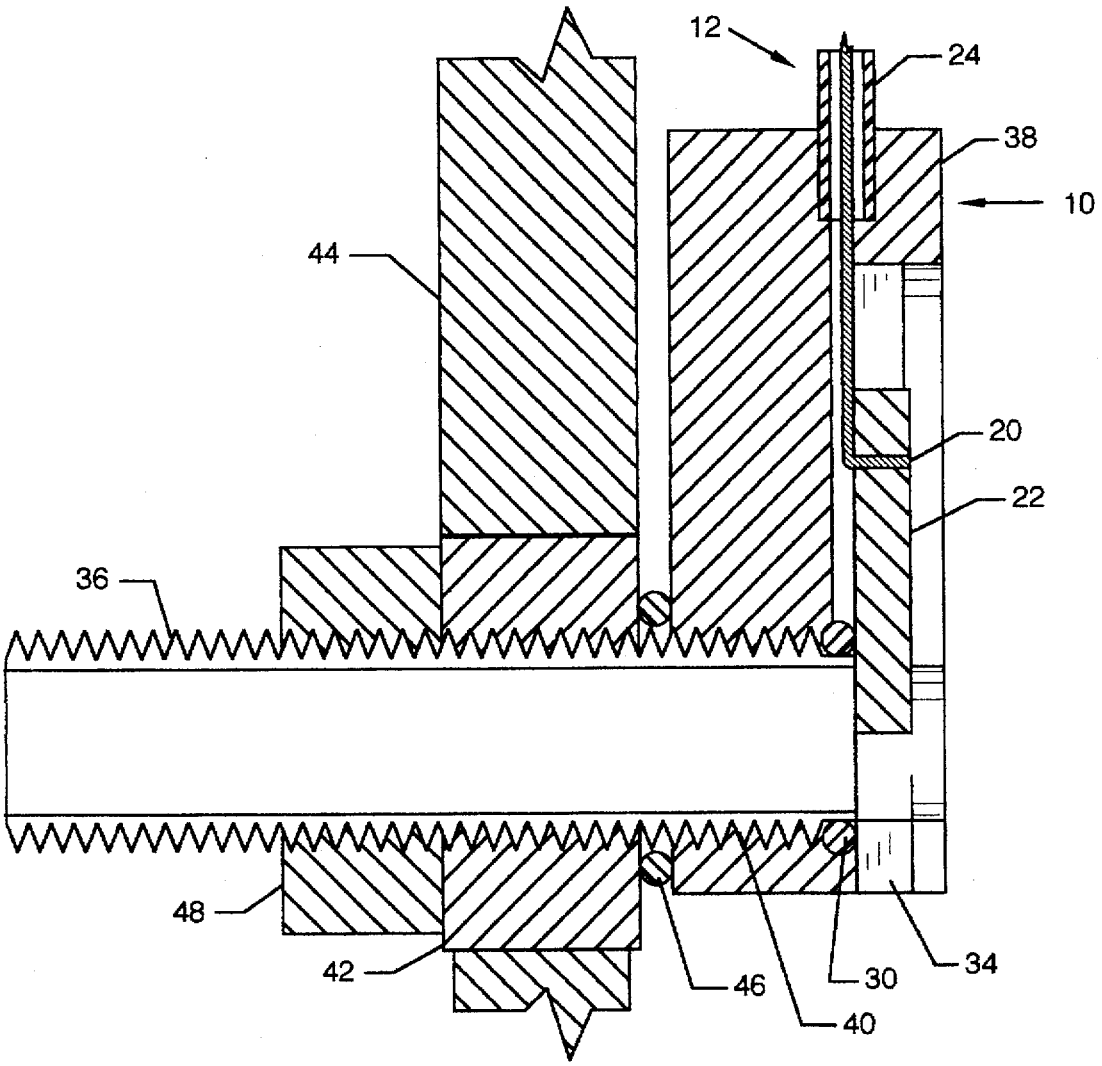
FIG. 3 illustrates a cross-sectional view of the boat plug assembly with the drain valve partially engaged.

FIG. 3 illustrates a cross-sectional view of the boat plug assembly 10 with the drain valve partially engaged, where all numerals correspond to those elements previously described. FIG. 3 further illustrates that the waterproof gasket 30 lies in an appropriately sized groove in the boat plug housing 38 and how the threaded drain tube 36 is secured to the boat plug housing 38 via threaded shaft 40. The threaded drain tube 36 screws into the existing drain hole fitting 42 of the boat's transom 44, and waterproof gasket 46 forms a waterproof seal between the boat plug assembly 10 and the transom 44. Nut 48 screws onto the threaded drain tube 36 and secures the boat plug assembly 10 to the drain hole fitting 42 of the transom 44. The boat plug assembly 10 comes in a variety of sizes to accommodate the various sizes of drain hole fittings found on boats.

Figure 4:
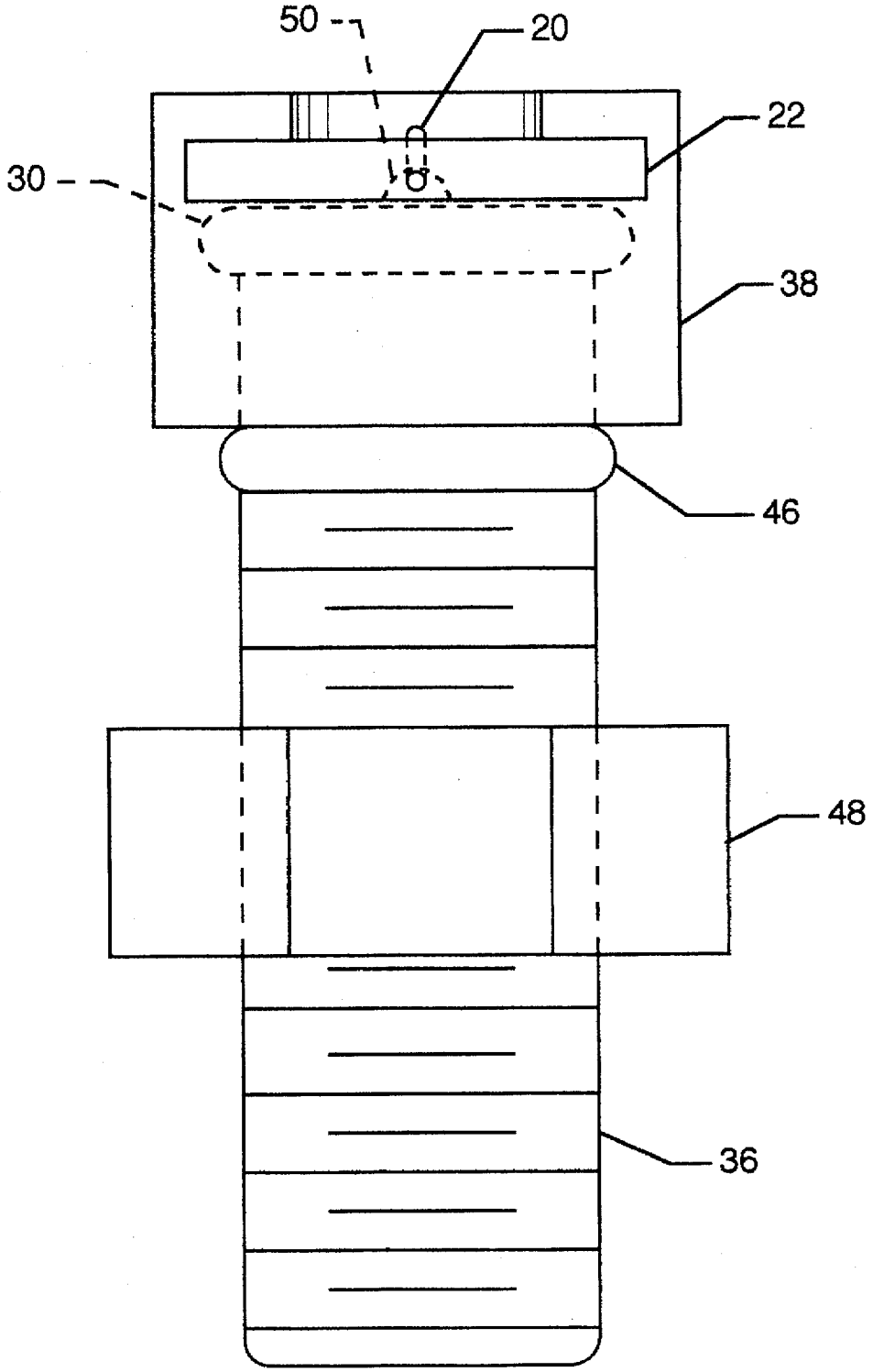
FIG. 4 illustrates a bottom view of the boat plug assembly.

FIG. 4 illustrates a bottom view of the boat plug assembly 10, where all numerals correspond to those elements previously described. FIG. 4 best illustrates the circular groove 50 in the boat plug housing 38 through which the actuator cable 20 slides and passes upward and catches the slide gate 22.

MODE OF OPERATION

Figure 5:
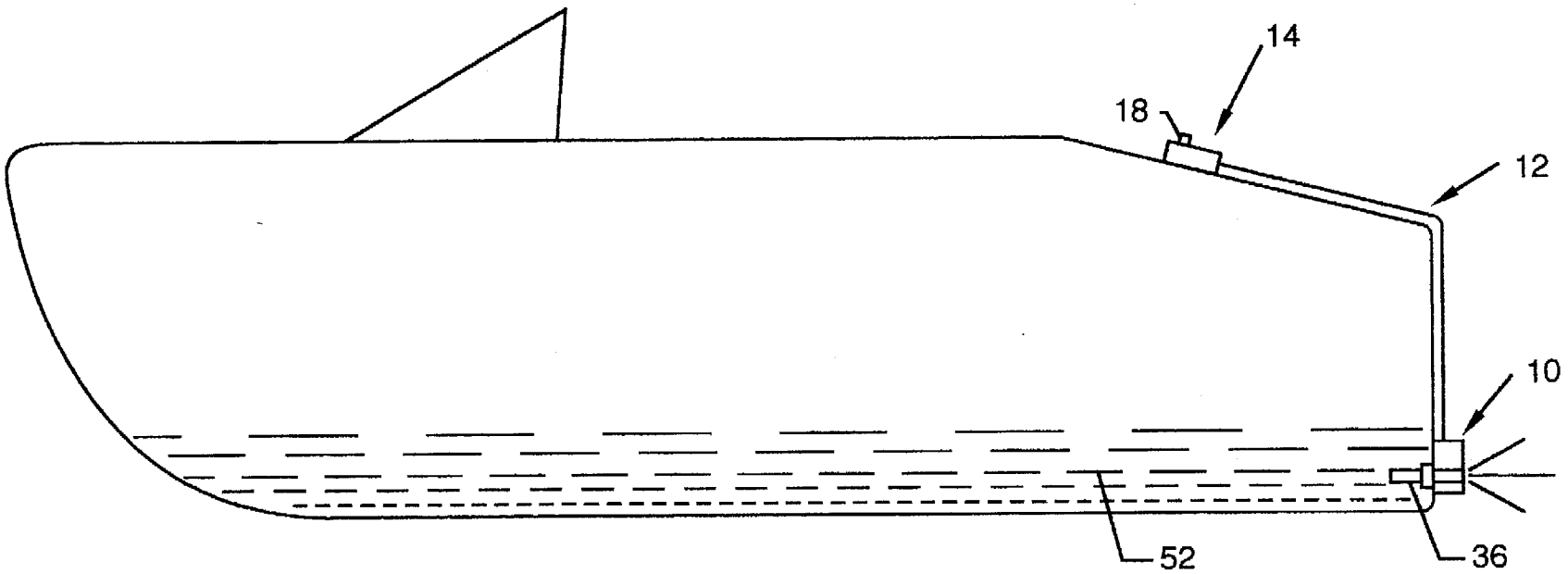
FIG. 5 illustrates the mode of operation of the present invention when the drain valve is opened.

FIG. 5 illustrates the mode of operation of the remote controlled boat drain valve, where all numerals correspond to those elements previously described. When a boat equipped with the remote controlled boat drain valve is taken out of the water, the actuator remote control assembly 14 is engaged by sliding the actuator slide 18 toward the front of the boat. The actuator slide 18 is connected to the actuator cable 20 which runs down the exterior of the boat to the boat plug assembly 10 mounted to the drain hole fitting 42 of the transom 44, as shown in FIG. 3. The actuator cable 20 connects to the slide gate 22, also shown in FIG. 3, and moves in the direction the actuator slide 18 is slid. When opened, the water 52 from the bilge of the boat passes through the threaded drain tube 36 and out of the boat. Closing the drain valve when the water has finished draining can be accomplished by sliding the actuator slide 18 toward the rear of the boat.

The remote controlled boat drain valve can also be used when the boat is in operation. When the boat is moving at high speed, centrifugal force causes the water 52 to move toward the rear of the boat's bilge. Opening the remote controlled boat drain valve at this time will allow the water 52 to pass through threaded drain tube 36 and out of the boat. It is important to close the remote controlled boat drain valve before reducing boat speed to eliminate the possibility of water re-entering the boat's bilge.

Various modifications can be made to the present invention without departing from the apparent scope hereof.

REMOTE CONTROLLED BOAT DRAIN VALVE

PARTS LIST

10 boat plug assembly
12 actuator cable assembly
14 actuator remote control assembly
16 actuator base
18 actuator slide
20 actuator cable
22 slide gate
24 cable protector
26 grooved slot
28 drain hole
30 waterproof gasket
32 slide gate channel
34 slide gate channel
36 threaded drain tube
38 boat plug housing
40 threaded shaft
42 drain hole fitting
44 transom
46 waterproof gasket
48 nut
50 circular groove
52 water

I claim:

1. A remote controlled boat drain system for a boat member valve comprising:

a. a boat drain housing including a configured slide gate channel;

b. a slide gate in said slide gate channel;

c. a threaded means extending at a right angle into said boat drain housing about a lower portion of said slide gate channel for engaging through a member of a boat; and, d. actuator means connected to said slide gate.

2. The system of claim 1, wherein said actuator means is an actuated lever means.

3. The system of claim 1, wherein said actuator means is a solenoid means.

* * * * *